United States Patent [19]

Lindblom et al.

[11] Patent Number: 4,675,926

[45] Date of Patent: Jun. 30, 1987

[54] CHAIR AND/OR BED ARRANGEMENT

[76] Inventors: Hans-Olov Lindblom, Box 4057, S-800 04 Gävle; Thomas Bergling, Frennarps Bygata 64, S-302 44 Halmstad, both of Sweden

[21] Appl. No.: 726,897

[22] PCT Filed: Aug. 16, 1984

[86] PCT No.: PCT/SE84/00277

§ 371 Date: Apr. 16, 1985

§ 102(e) Date: Apr. 16, 1985

[87] PCT Pub. No.: WO85/00745

PCT Pub. Date: Feb. 28, 1985

[30] Foreign Application Priority Data

Aug. 17, 1983 [SE] Sweden ..... 8304446
Aug. 17, 1983 [SE] Sweden ..... 8304447

[51] Int. Cl.[4] ..... A61G 7/00

[52] U.S. Cl. ..... 5/68; 5/60; 74/606 R

[58] Field of Search ..... 5/60, 66, 67, 68, 69; 74/606 R, 607

[56] References Cited

U.S. PATENT DOCUMENTS

| | | | |
|---|---|---|---|
| 646,467 | 4/1900 | Short | 74/606 |
| 2,564,083 | 8/1951 | Stechert | 5/67 |
| 2,996,732 | 8/1961 | Draper | 5/68 |
| 3,593,350 | 7/1971 | Knight et al. | 5/68 |
| 3,644,945 | 2/1972 | Goodman et al. | 5/68 |
| 4,120,057 | 10/1978 | Neumann | 5/68 |
| 4,345,344 | 8/1982 | Gadoury et al. | 5/68 |

FOREIGN PATENT DOCUMENTS

| | | | |
|---|---|---|---|
| 594804 | 6/1959 | Italy | 5/67 |

*Primary Examiner*—Alexander Grosz
*Attorney, Agent, or Firm*—Charles E. Brown; Charles A. Brown

[57] ABSTRACT

A bed comprises a base (1), a frame (2), which is vertically adjustable relative to the base by means of pivot arms (3), lying members (7–9), which are adjustable relative to the frame (2) by means of second pivot arms (12, 13) and power devices on the frame for causing the pivot arms to move. The frame (2) is designed as a container generally closed at all sides, said power devices being enclosed within said container, the pivot shafts of the pivot arms extending into the interior of the container through wall portions thereof. (FIG. 2).

10 Claims, 6 Drawing Figures

CHAIR AND/OR BED ARRANGEMENT

FIELD OF INVENTION AND PRIOR ART

This invention relates to a chair and/or bed arrangement of the kind defined in the preamble of appendant claim 1.

Such an arrangement is disclosed in U.S. Pat. No. 3,593,350. The frame therein consists of a lathwork formed by longitudinal and transversal beams. Power exerting devices and a large number of links and the like for attaining the desired adjustability are secured to the transversal beams. Chairs or beds of this kind are primarily used within the medical sector, for what reason the requirements as to hygiene as a rule are high. Thus, the chairs and beds must be cleaned with regular intervals. The cleaning work in connection with the bed in the US patent is tiresome to say the least due to the large number of operating components being entirely exposed in the frame. Careless cleaning may easily lead to operating disturbances of the exposed motors, in particular if they are of electrical type. Automatical cleaning procedures can probably hardly be applied in connection with the prior art bed.

SUMMARY OF THE INVENTION

The object of the invention is to reduce the deficiencies discussed hereinabove and achieve a chair and/or bed arrangement having a form and design as simple as possible at the same time as cleaning must be possible to carry out rapidly without jeopardizing the result.

This object is obtained according to the invention in that the frame is designed as a container generally closed at all sides, said power exerting devices being housed within said container, and that pivot shafts for the operating members, which are designed as pivot arms, extend into the interior of the container through wall portions thereof. In this way an embodiment is obtained which to a maximum extent makes it possible to house operating components within the frame. The cleaning work will thereby generally be restricted to flat surfaces with a minimum of areas difficult to reach.

BRIEF DESCRIPTION OF THE DRAWINGS

With reference to the appended drawing, a more specific description of an embodiment example of the invention will follow hereinafter.

In the drawings

DETAILED DESCRIPTION OF A PREFERRED EMBODIMENT

Figure 1:
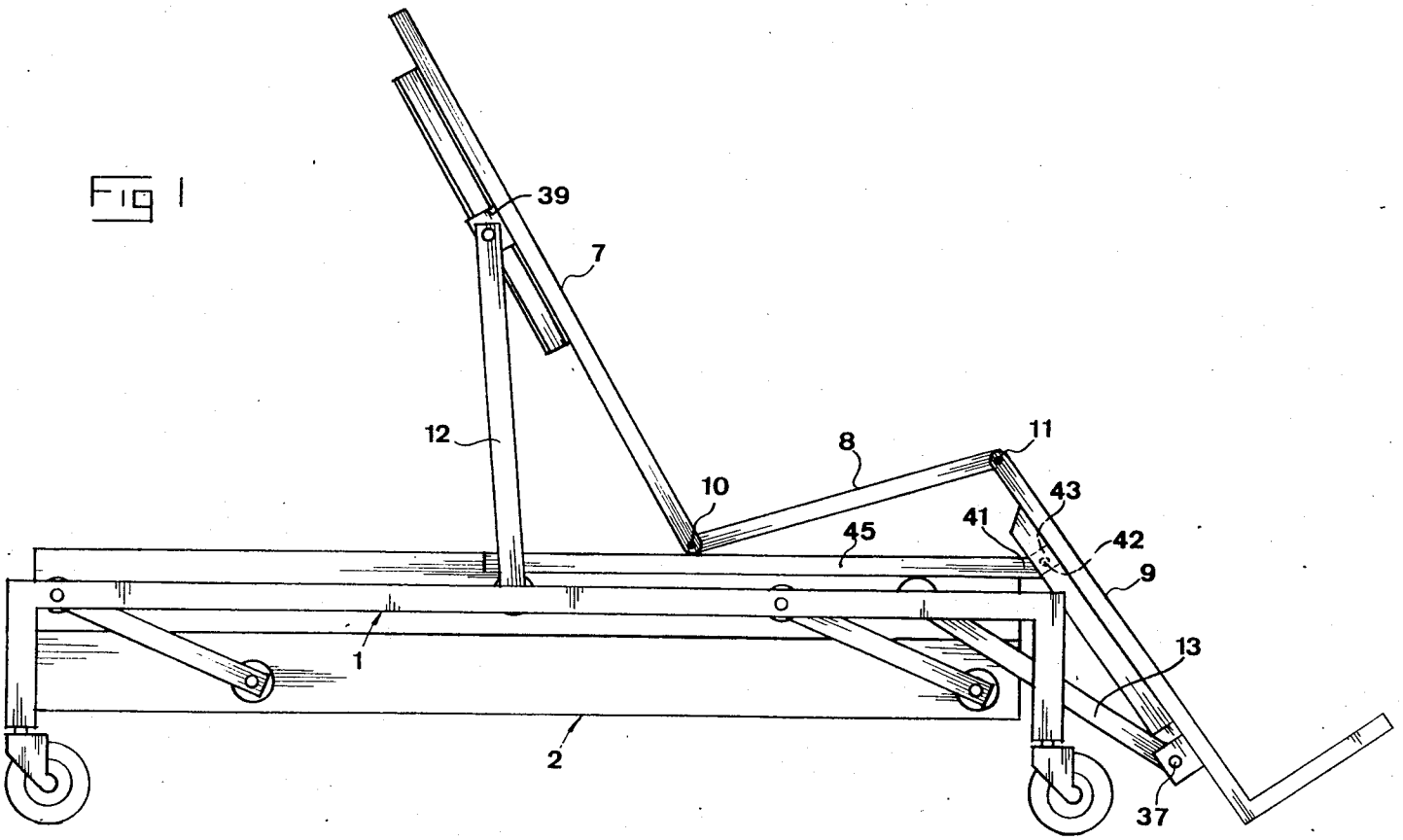
FIGS. 1–3 are side views of the arrangement in three different positions of use.

The arrangement according to the invention will hereinbelow be described as primarily functioning as a bed. However, it should be noted that the invention as well can be applied in connection with arrangements having as primary task to function as a chair.

The bed comprises a base 1, which may be provided with wheels to simplify transport, and a frame in the form of a girder 2, which is vertically adjustable relative to the base by means of first operating members 3. The operating members are formed by two pairs of pivot arms 3. The two pivot arms in each individual pair extend in a spaced parallel relation and are non-rotatably connected to each other at one of their ends by means of a shaft 4. The other ends of the pivot arms 3 are via shafts 5 pivotably connected to longitudinal and parallel beams 6 arranged at a distance from each other in the base 1. The pivot shafts 4 of the two pairs of pivot arms and the shafts 5 form a parallelogram.

Figure 4:
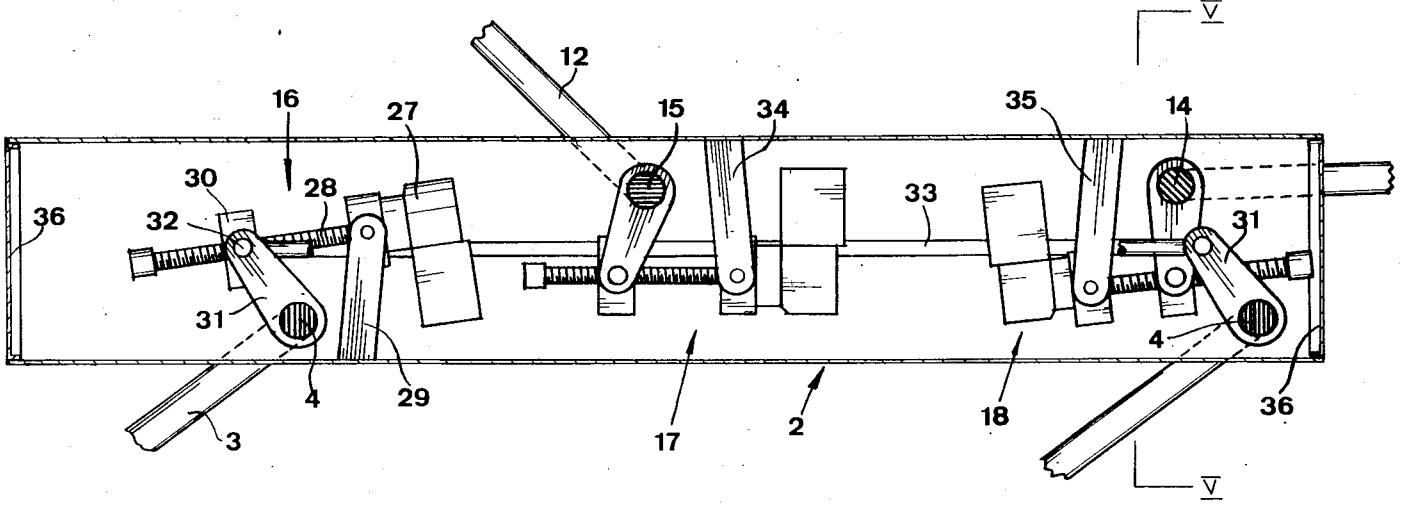
FIG. 4 is a diagrammatical longitudinal section through the frame as viewed in a position corresponding to FIG. 3.
Figure 5:
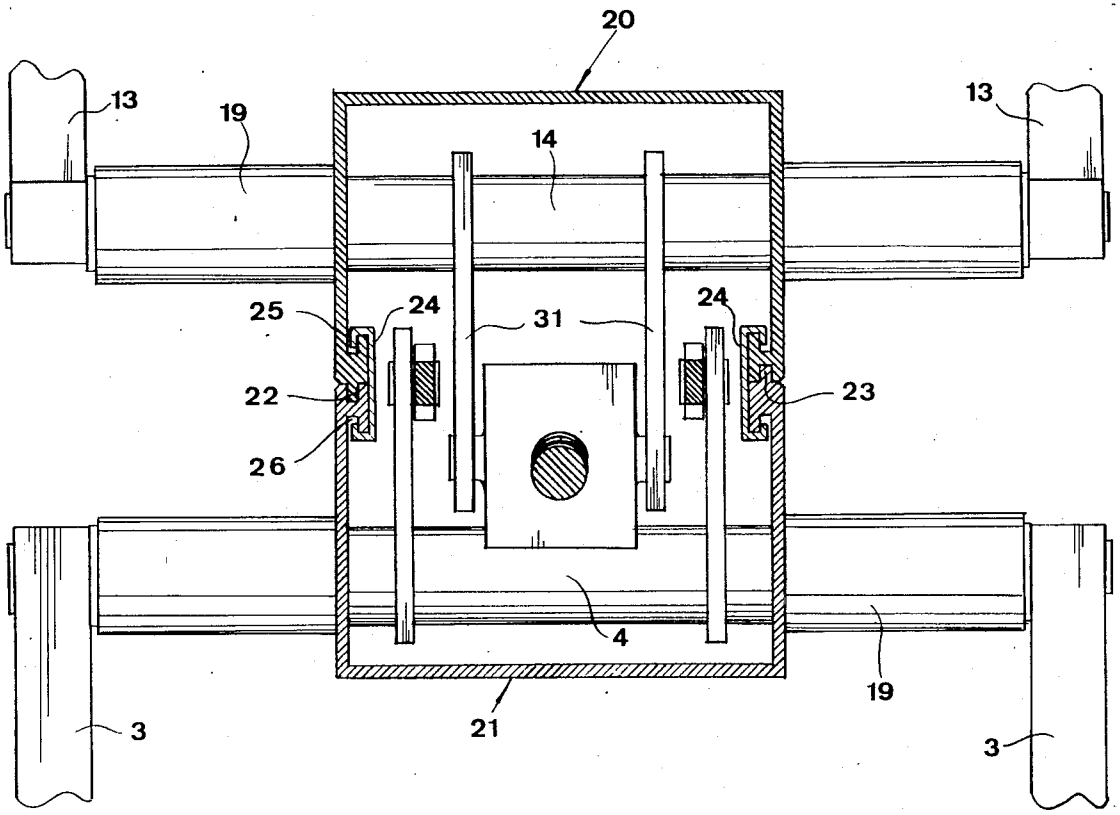
FIG. 5 is a cross section as viewed along the line V—V in FIG. 4.

The lying surface of the bed is formed by a back member 7, a seat member 8 and a leg member 9, which are connected to each other via hinges 10 and 11 respectively. Additional operating members in the form of two pairs of pivot arms 12, 13 serve for adjustment of members 7–9. Each of the pivot arms in these two pairs are, as is indicated in FIG. 5 concerning the arms 13, non-rotatably connected at one or their ends to the opposite ends of a pivot shaft 14 while the arms extend in parallel. The pivot shaft 15 connecting the pivot arms 12 is indicated in FIG. 4. The pivot arms 12 are adapted to actuate back member 7 with their ends opposite the shaft 15, while the pivot arms 13 are adapted to actuate leg member 9 with their ends opposite shaft 14.

The girder 2 is designed as a container generally closed at all sides, power exerting devices 16, 17, 18 for obtaining pivoting of arms 3, 12, 13 being housed within said container. The pivot shafts of these arms extend into the interior of the container or girder 2 through wall portions thereof. More specifically, the horisontal pivot shafts 4, 14, 15 extend through vertical side walls of the container, which has the character of an elongated box girder having a generally uniform cross section.

As appears from FIG. 5, shafts 4, 14 (and also shaft 15) extend throughout the girder 2 and the respective pivot arms are attached to the shafts at their extreme ends at opposite sides of the girder. The ends of the shafts protrude through bearing sleeves 19 secured to the girder.

The girder 2 is composed of two portions 20, 21 detachable from each other, said portions being designed as U-shaped profiles, the generally vertical branches of which are directed towards and connected to each other. The branches of each of the profiles 20, 21 are at their extreme ends provided with grooves 22 and projections 23 respectively for engagement with corresponding projections and grooves respectively in the branches of the other profile. The profiles 20, 21 have identical cross section in that they each on one of their branches have a groove 22 and on the other a projection 23.

The profiles 20, 21 are assembled by means of strips 24, which have a C-shaped cross section and are arranged to engage about portions of the outer ends of the branches of the two profiles and maintain the same applied against each other so as to make the projections 23 and grooves 22 maintain their engagement. The longitudinal free end portions 25 on the strips 24 may be bent towards each other so as to be able to engage in longitudinal recesses 26 on the branches. Due to this, the strips 24 must accordingly be treaded on to the branches in the longitudinal direction of girder 2.

The lower profile 21 is connected to the pivot shafts 4 of the pairs of arms 3 in that the shafts protrude through openings in the branches of the profile although the shafts are rotatable relative thereto. The shafts 14, 15 belonging to the arms 12, 13 for operating the bed members 7–9 are associated to the upper profile 20 in that said shafts extend through the branches thereof.

Each of the power exerting devices 16, 17 and 18 (FIG. 4) comprises an electric motor 27 adapted to drive a screw 28. The motor 27 is pivoted about a transverse horisontal axis in relation to an attachment 29. The screw 28 is in engagement with a nut 30, which is hingedly connected to a lever 31 about a transverse axis 32, said lever being rigidly attached to the pivot shaft of a pivot arm. The device 16 is adapted to move the pivot arms 3 and the lever 31 directly secured to the nut 30 is accordingly attached to one of the pivot shafts 4. The other pivot shaft 4 is given its movement through rods 33 connecting the nut 30 to a lever 31 arranged on the other pivot shaft. The attachment 29 for the device 16 is secured to the lower profile 21. The drive device 17 having a similar design is adapted to cause shaft 15 to rotate and the motor attachment 34 thereof is secured to the upper profile 20. Also the motor attachment 35 for the device 18 for causing the pivot shaft 14 for the arms 13 to rotate is secured to the upper profile 20.

The girder 2 is at its ends closed by means of end pieces 36. Leads for supplying the three motors 27 with current or other propellant pass preferably through one of the end pieces via contact means arranged therein. The end pieces 36 may be full sized or divided into two halves, an upper half being attached to the upper profile 20 while a lower half is attached to the lower profile 21. In order to control the various power exerting devices, regular remote control equipment is used so that a person resting on the bed may himself adjust the girder 2 into different heights relative to the base 1 and the bed members 7–9 into different positions relative to girder 2.

By the stated design of the girder 2, access to drive components within the girder may easily be achieved by removing the strips 24 after possible removal of the end pieces 36 and detachment of electrical leads. Thereafter, the upper profile 20 with adhering shafts 14, 15 and arms 12, 13 and bed members 7–9 carried thereby may simply be lifted off the lower profile 21. The drive device 16 remains with the profile 21 while the devices 17 and 18 follow the profile 20.

One of the pairs of pivot arms 12, 13 have their contact points relative to member 7 or 9 in question stationarily hingedly connected to said member while the other pair of pivot arms have their contact points displaceable along the other of the members. More specifically, the arms 13 have their outer ends stationarily hingedly connected to leg member 9 about a transverse horisontal axis 37. The pivot arms 12 have their outer ends displaceable along the back member 7 in longitudinal guides 38. These guides have a U-shaped cross section with the branches directed towards the respective sides of the bed while slide pieces 39 are arranged on pivot arms 12, said slide pieces running between the branches of the guides and being, via axes 40 pivoted to the arms. The members 7–9 and hinges 10, 11 therebetween are displaceable along the girder 2. Furthermore, the hinges 10, 11 are free to move vertically and adapted to rest on and slide along respectively the upper side of the girder 2. In the vicinity of the hinges, suitable slide pieces may be arranged. The weight of a person resting on the bed maintains the seat member 8 pressed downwardly.

Figure 3:
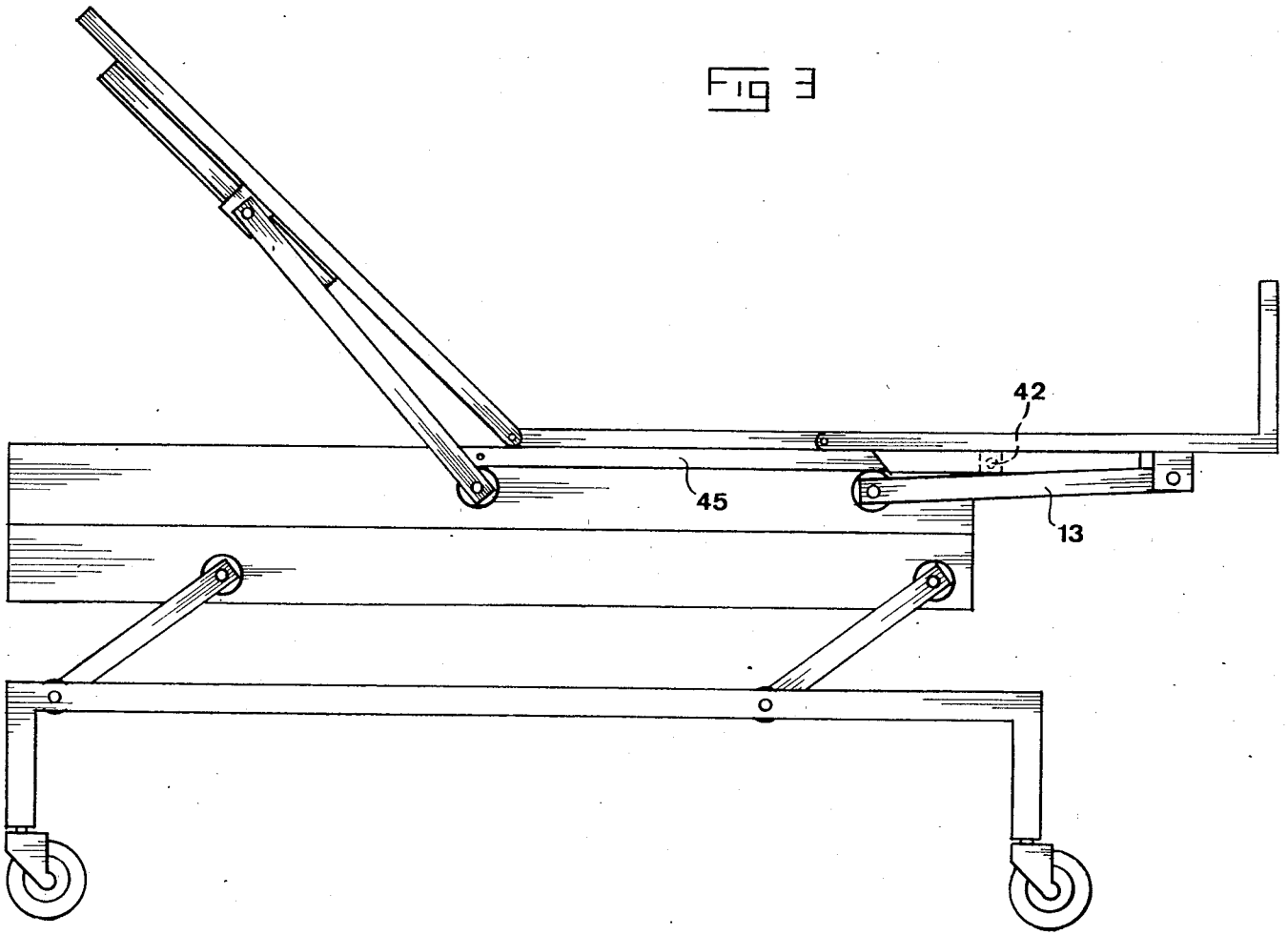

As appears from FIG. 3, the shafts 14, 15 are, when the seat member 8 is in a horizontal position, located relatively close to the hinges 10, 11 and the pivot arms 12, 13 extend away from these shafts generally parallel to the back member and the leg member. Thus, there is a distance between the hinge 10 and the contact points 40 of the arms 12 relative to the back member 7 and between the hinge 11 and the contact points 37 of the arms 13 relative to the leg member 9.

The leg member 9 extends past the adjacent end of the girder 2, at which end there is a support member 41 adapted to co-operate with the leg member 9 in order to form a pivot point 42 therefor. The pivot point is located between the hinge 11 and the hinge 37, the leg member 9 being longitudinally displaceable relative to the pivot point. The pivot point 42 is formed by a transverse hinge between the support member 41 and a slide piece 43, which is received in a longitudinal guide 44 on the leg member, said guide preventing relative movement between the support member and the leg member perpendicularly to the longitudinal direction of the guide in the vertical plane.

Figure 2:
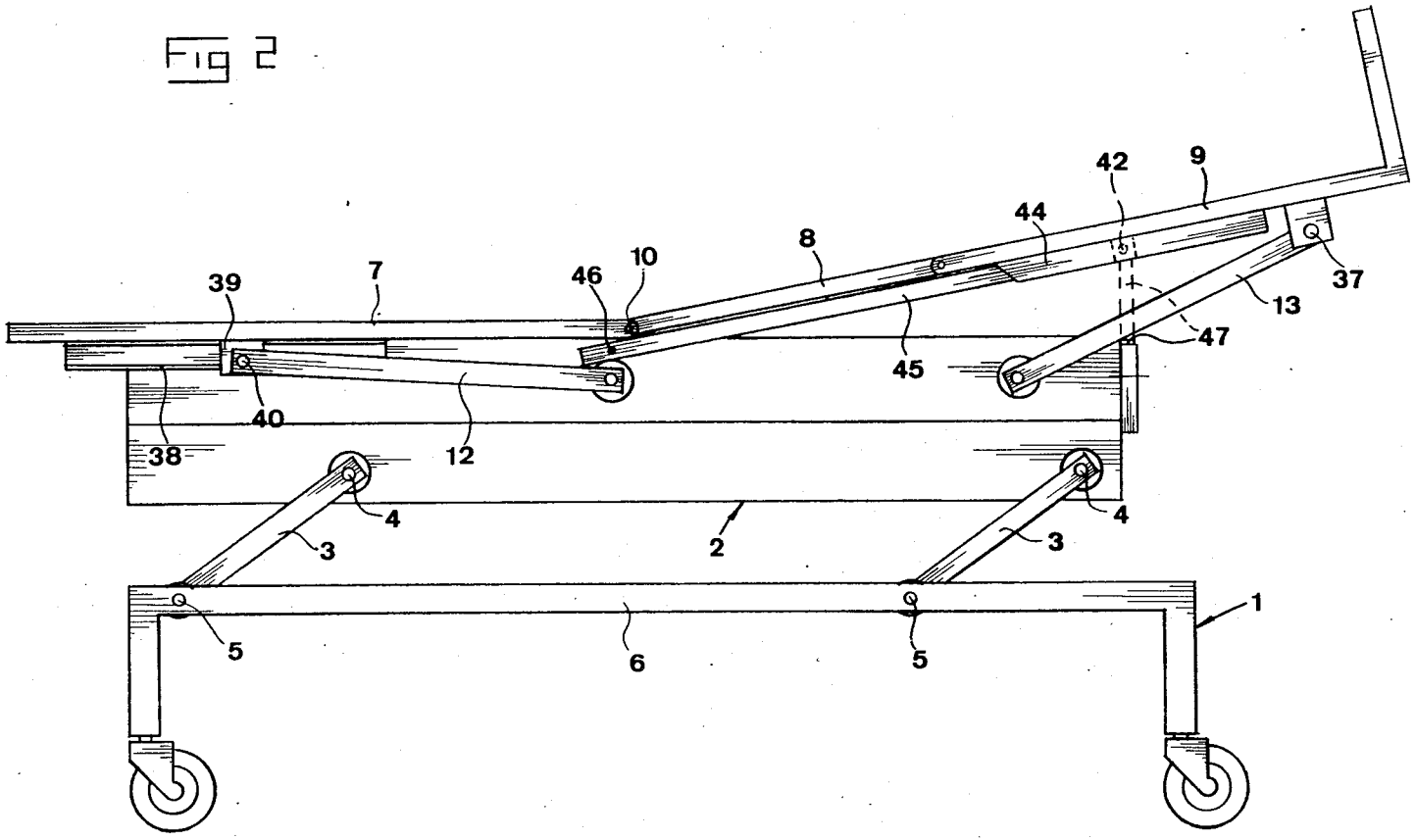

The support member 41 and slide piece 43 are arranged on a link 45 pivotable in the vertical plane, said link being hingedly connected (via a transverse axis 46) to the girder 2 in the vicinity of the hinge 10. The hinge 46 may also be located more close to the head end of the bed than said hinge 10. In practice, two sets of components 41–43 and 45, 46 are arranged on opposite sides of the girder 2. More specifically, the links 45 may have their hinges 46 located in association with the sleeves 19 about the pivot shaft 15 or in the vicinity thereof and be adapted to rest on the sleeves 19 about the pivot shaft 14 in the position according to FIG. 3. The upper side of the links 45 preferably lies in one and the same plane as the upper side of the girder 2 and slide pieces or the like in connection with the hinges 10 and 11 may possibly rest also against the links 45, which are designed to support the leg member and seat member, in particular via the hinge 11 therebetween, so that these members form a generally planar surface when the link is pivoted upwardly (to the position in FIG. 2).

There are means for adjusting the vertical position of the pivot point 42. Said means may take the shape of a support, which is located at the foot end of the girder and adjustable between a lower position, in which the pivot point 42 is allowed to assume its lowermost position, and an upper position (indicated with dashed lines in FIG. 2), in which the support 47 supports the hinge 42 and support member 41 in a lifted position. The support is by means of a locking pin or the like securable in the upper position.

It appears from the above that the inclination of the back member 7 may be adjusted by means of arms 12. Starting from a position in which members 8 and 9 form a plane (FIG. 3) the arms 13 may be pivoted downwardly so that the leg member 9 is pivoted about the point 42 and the hinge 11 moves upwardly and forwardly while the hinge 10 slides along the girder 2. In this way the sitting position according to FIG. 1 may be assumed. By pivoting the arms 13 upwardly, it can be obtained that members 8 and 9 form a sloping plane according to FIG. 2 in that the links 45 support members 8 and 9 from below. If the support 47 is brought to the position in FIG. 2 indicated with dashed lines, subsequent pivoting downwardly of the arms 13 will give rise to pivoting of the leg member 9 about the pivot point 42 which at that time is located above the girder 2.

It is primarily intended that the arms 12 and 13 should be individually controlled although predetermined patterns of movement programmed into a control unit may be based upon coordinated movements of the arms.

Figure 6:
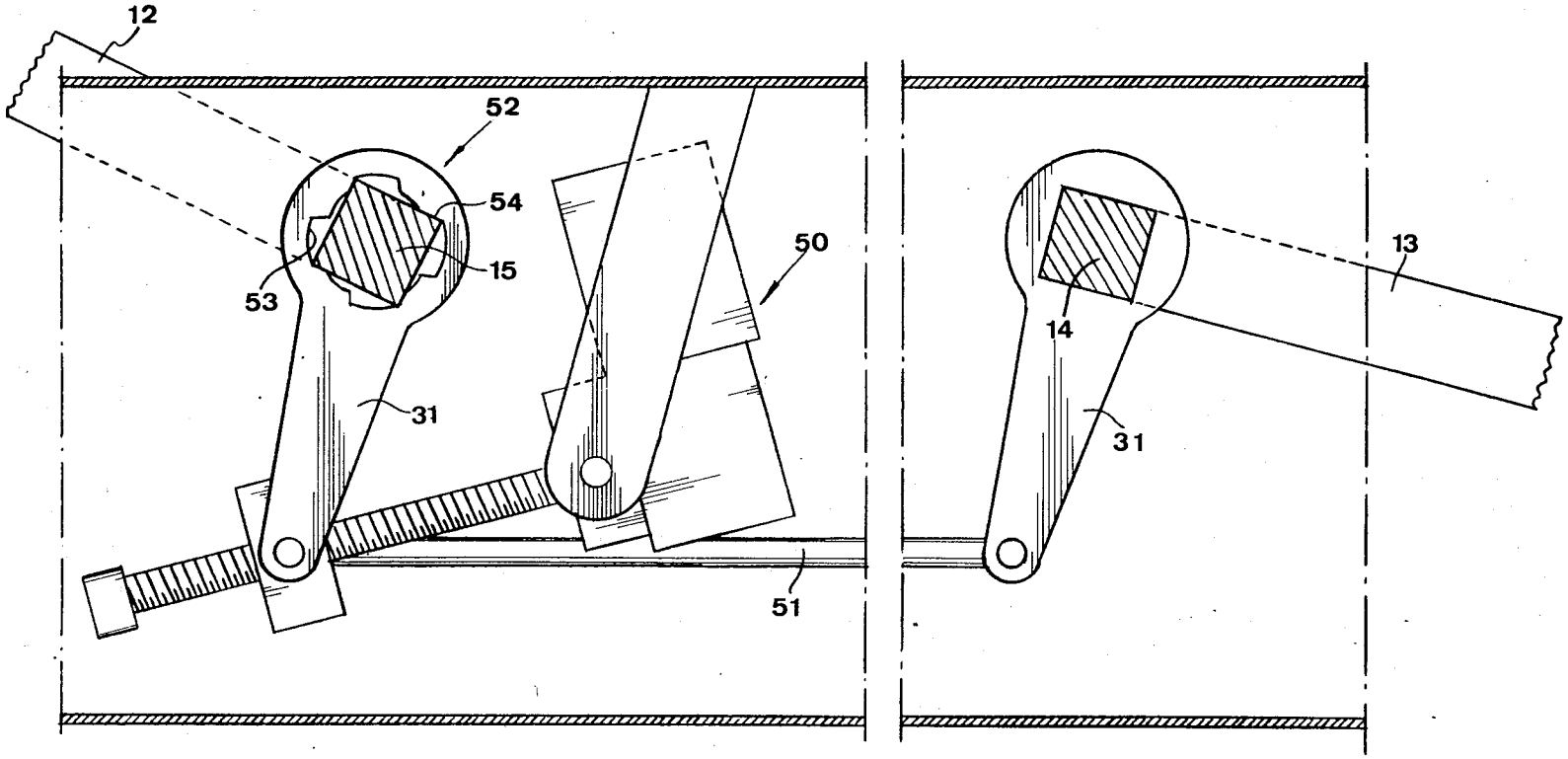
FIG. 6 is a longitudinal section illustrating an alternative embodiment.

In FIG. 4 it is illustrated that the pairs of pivot arms 12 and 13 are moved by means of separate power devices 17 and 18. Although such an embodiment gives a good freedom for movement, it is sometimes desireable, in order to achieve a non-expensive embodiment, to be able to manage with a single power device for the pivot arms 12 and 13. Such an embodiment is illustrated in FIG. 6. As previously, the pairs of pivot arms are each rigidly connected to shafts 14, 15 on which levers 31 are mounted. These levers are interconnected by means of a rod 51. The power device 50, which is principally similar to the devices 16–18 previously described, is adapted to actuate the lever 31 associated to shaft 15. Between the two pairs of pivot arms, there is provided a transmission 52 coordinating the movements of the pivot arms so that when the pair of pivot arms 12 and accordingly the back member are pivoted upwardly from a generally horisontal lying position, the pair of arms 13 and accordingly the foot end of the leg member are pivoted downwardly, but when the back member is in a horisontal lying position and the pair of arms 13 and accordingly the foot end of the leg member are pivoted upwardly, the back member remains in said lying position. The transmission 52 is in the present case arranged in the connection of the shaft 15 and the associated lever 31 but it should be understood that the basic thing only is that the transmission in question should be arranged between the pair of arms 12 and some component being put into movement by means of the power device 50. As an example, the power device 50 could be adapted to actuate the lever non-rotatably connected to the shaft 14 and the transmission 52 could be designed so as to allow the intended free movement in the connection between the rod 51 and the lever connected to the shaft 15.

The restricted free movement of the transmission 52 is in the present case obtained in that the shaft 15 is provided with a square portion, which is received in a recess 53 in the lever 31, said recess being designed so as to allow a restricted free relative rotational movement between the pair of arms 12 and the lever 31. When the pair of arms 12 is to be pivoted upwardly for raising the back member, the corners of the square shaft portion engage surfaces delimiting the recess 53 and forming stops 54. In this way a direct force transmission to the pair of arms 12 is achieved. However, when the arms 12 and back member are lowered into a horisontal lying position, they will remain in that position, continued pivoting in a counter clockwise sense of the lever 31 causing free movement between this lever and the arms 12 at the same time as the arms 13 are caused to pivot upwardly via the rod 51 so that accordingly the position according to FIG. 2 can be obtained.

The arrangement according to the invention can of course be modified in several ways within the inventive concept. As an example, the pivot point 42, which has been described as displaceable in the longitudinal direction of the leg member 9, can be secured to and accordingly non-displaceable along said leg member 9. In such a case, the hinge 37 connecting the arms 13 and the leg member 9 should be arranged displaceable by means of suitable guides in the longitudinal direction of the leg member 9.

We claim:

1. A chair and/or bed arrangement comprising a base, at least one sitting and/or lying member, which is pivotable about a horizontal axis by means of at least one first pivot arm, at least one first power exerting device for actuating said first pivot arm, a container generally closed at all sides, said first power exerting device being housed within said container, said container being supported relative to the base by means of a supporting device, said first pivot arm having a pivot shaft extending into the interior of the container, the supporting device comprising at least one second pivot arm which is similar to said first pivot arm and having a pivot shaft extending into the interior of the container through a wall portion thereof, a second power exerting device for actuating the second pivot arm being also housing within said container the container constituting a supporting connection between the first and second pivot arms and serving as a transmitter of support forces between the sitting and/or lying member and the base, the container having the character of a box girder having top, bottom and side walls, said girder being longitudinally elongated and having a substantially smaller width than the sitting and/or lying member, and the pivot shafts for the first and second pivot arms penetrating through the side walls of the girder.

2. An arrangement according to claim 1; characterized in that the container has a generally uniform cross section.

3. An arrangement according to claim 1, characterized in that the first and second pivot arms are pivotable in generally vertical planes, and the container side walls through which said pivot shafts extend are generally vertical side walls.

4. An arrangement according to claim 1, characterized in that each power exerting device comprises a motor connected to drive a screw, said motor and screw being hingedly connected to the container, and the screw engaging a nut hingedly connected to a lever rigidly attached to a respective one of the pivot shafts.

5. An arrangement according to claim 1, characterized in that the sitting and/or lying member includes a back member, a seat member and a leg memer, said seat member being hingedly connected to said back member and said leg member, there being at leat two of said first pivot arms for pivoting the back member and the leg member in a vertical plane, said first power exerting device being arranged for common operation of the two first pivot arms, said first power exerting device being operable to actuate the first pivot arm associated with the back member via a transmission allowing such a free movement that when the back member is pivoted upward from a generally horizontal lying position, a foot end of the leg member is pivoted dowardly, but when the back member is in a horizonal lying position and the foot end of the leg member is pivoted upwardly, the back member remains in said horizontal lying position.

6. A chair and/or bed arrangement comprising a base, at least one sitting and/or lying member, which is pivotable about a horizontal axis by means of at least one first pivot arm, at leasts one first power exerting device for actuating said first pivot arm, a container generally closed at all sides, said first power exerting device being housed within said container, said container being supported relative to the base by means of a supporting device, said first pivot arm having a pivot shaft extending into the interior of the container, the supporting device comprising at least one second pivot arm which is similar to said first pivot arm and has a pivot shaft extending into the interior of the container through a wall portion thereof, a second power exerting device for actuating the second pivot arm being also housed within said container, the container constituting a supporting connection between the first and second pivot arms and series as a transmitter of support forces between the sitting and/or lying member and the base, the container having at least two portions detachable from each other, one of said portions being connected to the pivot shaft of the second pivot arm for adjusting the container relative to the base and to the power exerting device for said second pivot arm, the other of said portions being connected to the pivot shaft of the first pivot arm for adjusting the sitting and/or lying member relative to the container and to the power exerting device for said first pivot arm.

7. An arrangement according to claim 6, characterized in that one of the two container portions is arranged on top of the other of the two container portions.

8. An arrangement according to claim 7, characterized in that the two container portions are in the form of U-shaped profiles having generally vertical branches directed towards and connected to each other, and the branches of each of the profiles at their outer ends are selectively provided with grooves and projections for engaging corresponding projections and grooves respectively in the branches of the other of said profiles.

9. An arrangement according to claim 8, characterized in that the two profiles are identical in cross section and one of the branches has a groove and on the other of the branches there is a projection.

10. A chair and/or bed arrangement comprising a base, at least one sitting and/or lying member, which is pivotable about a horizontal axis by means of at least one first pivot arm, at least one first power exerting device for actuating said first pivot arm, a container generally closed at all sides, said first power exerting device being housed within said container, said container being supported relative to the base by means of a supporting device, said first pivot arm having a pivot shaft extending into the interior of the container, the supporting device comprising at least one second pivot arm which is similar to said first pivot arm and having a pivot shaft extending into the interior of the container through a wall portion thereof, a second power exerting device for actuating the second pivot arm being also housed within said container, the container constituting a supporting connection between the first and second pivot arms and serving as a transmitter of support forces between the sitting and/or lying member and the base, said sitting and/or lying member including a back member, a seat member and a leg member, means hingedly connecting said seat member to said back member and said leg member, there are being two of the first pivot arms for pivoting the back member and the leg member in the vertical plane, a frame including a support member for cooperating with the leg member to form a pivot point therefor, said pivot point being located between on one hand the hinge connection between the leg member and the seat member and on the other hand the hinge connection between the leg member and the first pivot arm associated with the back member, and the support member being arranged on a vertically pivotable link for supporting the leg member and seat member so that they form a generally planar surface or otherwise assume a predetermined mutual angular relation when the vertically pivotable link and the leg member are pivoted upwardly by means of the first pivot arm associated with the leg member.

* * * * *